US008933004B2

(12) United States Patent
Liu et al.

(10) Patent No.: US 8,933,004 B2
(45) Date of Patent: Jan. 13, 2015

(54) MINERAL OILS CONTAINING PHENOLIC ANTIOXIDANTS WITH IMPROVED COLOR STABILITY

(75) Inventors: Bo Liu, Union, KY (US); Vince J. Gatto, Baton Rouge, LA (US); Gangkai Zhao, Shanghai (CN)

(73) Assignee: SI Group, Inc., Schenectady, NY (US)

( * ) Notice: Subject to any disclaimer, the term of this patent is extended or adjusted under 35 U.S.C. 154(b) by 0 days.

(21) Appl. No.: 13/978,558

(22) PCT Filed: Jan. 6, 2012

(86) PCT No.: PCT/US2012/020454

§ 371 (c)(1), (2), (4) Date: Jul. 8, 2013

(87) PCT Pub. No.: WO2012/096836

PCT Pub. Date: Jul. 19, 2012

(65) Prior Publication Data

US 2013/0281338 A1 Oct. 24, 2013

Related U.S. Application Data

(66) Substitute for application No. 61/431,120, filed on Jan. 10, 2011.

(51) Int. Cl.

| | |
|---|---|
| ***C10M 169/04*** | (2006.01) |
| ***C10M 159/12*** | (2006.01) |
| ***C10M 133/06*** | (2006.01) |
| ***C10L 1/18*** | (2006.01) |
| ***C10L 1/23*** | (2006.01) |
| ***C10M 133/36*** | (2006.01) |
| ***C10M 141/06*** | (2006.01) |

(52) U.S. Cl.

CPC ..... *C10L 1/23* (2013.01); *C10M 133/36* (2013.01); *C10M 141/06* (2013.01); *C10M 2207/026* (2013.01); *C10M 2215/206* (2013.01); *C10N 2230/20* (2013.01)

USPC ..... 508/503; 508/548; 44/388

(58) Field of Classification Search

USPC ..... 508/503, 548; 44/388

See application file for complete search history.

(56) References Cited

U.S. PATENT DOCUMENTS

| | | | | |
|---|---|---|---|---|
| 3,644,278 | A | 2/1972 | Klemchuk | |
| 3,926,909 | A | 12/1975 | Wei | |
| 3,956,148 | A * | 5/1976 | Swietlik et al. | 508/560 |
| 4,590,231 | A | 5/1986 | Seltzer et al. | |
| 5,023,283 | A | 6/1991 | Ravichandran et al. | |
| 2005/0209379 | A1 | 9/2005 | Botkin et al. | |
| 2008/0234153 | A1 * | 9/2008 | Matsui | 508/329 |
| 2009/0005478 | A1 * | 1/2009 | Gelbin et al. | 524/186 |
| 2011/0239972 | A1 | 10/2011 | Kamano et al. | |

* cited by examiner

*Primary Examiner* — Vishal Vasisth

(74) *Attorney, Agent, or Firm* — Jeffrey N. Townes; LeClairRyan

(57) ABSTRACT

This invention relates to a mineral oil containing hindered phenolic antioxidants with improved color stability. More particularly, it relates to non-coloring hindered phenolic blend that contains an oxygen scavenger, i.e., dibenzylhydroxyl amine (DBHA) as well as mineral oils containing such a blend.

12 Claims, No Drawings

MINERAL OILS CONTAINING PHENOLIC ANTIOXIDANTS WITH IMPROVED COLOR STABILITY

This application is a 371 of PCT/US12/20454, filed Jan. 6, 2012 which claims benefit of 61/431,120, filed Jan. 10, 2011.

FIELD OF THE INVENTION

This invention relates to a mineral oil containing hindered phenolic antioxidants with improved color stability. More particularly, it relates to color stable hindered phenolic concentrate or mineral oil blend that contains an oxygen scavenger, i.e., dibenzylhydroxylamine (DBHA).

BACKGROUND OF THE INVENTION

Hindered phenolic compounds have been used as effective antioxidants in lube and fuel applications. The phenolic compounds react with peroxy radicals present in the oxidative chain reaction to form stable antioxidant radicals, thus further degradation is prevented. However, the mineral oils and hindered phenolic compounds have a tendency to discolor from exposure to sunlight, oxygen and/or heating. Oxidation of the mineral oils and the hindered phenolic compounds results in conjugated species that are colored. Colors ranging from yellow or pink to dark red can occur over time due to further discoloration. Variations in the color of mineral oils as a result of the discoloration due to oxidation distract the commercial value of such oils. Users of mineral oils often use color as a measure of contamination, with high color indicating contaminated oil that is not acceptable for use. Thus, it would be commercially advantageous to provide a mineral oil formulation that is resistant to oxidation and is color stable.

SUMMARY OF THE INVENTION

The present invention relates to an antioxidant composition, suitable to prevent oxidation of a mineral oil, comprising dibenzylhydroxylamine and at least one hindered phenol selected from the group consisting of: (i) ortho-tert-butylphenol, (ii) 2,6-di-tert-butylphenol, (iii) 3,5-di-tert-butyl-4-hydroxyphenylhydrocinnamic acid, C7-C9 branched alkyl esters, (iv) 4,4'-methylenebis(2,6-di-tert-butylphenol), and mixtures thereof.

It has been discovered that a combination of dibenzylhydroxylamine (DBHA) and hindered phenolic antioxidants produce a non-coloring hindered phenolic antioxidant system effective as an antioxidant in mineral oils. It has also been discovered that combinations of certain dibenzylhydroxylamine with one or more hindered phenolic antioxidants are effective at producing non-coloring hindered phenolic antioxidant system concentrates that are fully liquid at room temperature and effective as antioxidants when added to naphthenic and/or paraffinic-based mineral oils. This invention also relates to a method of reducing the color of off-color mineral oils comprising the steps of (i) contacting dibenzylhydroxylamine with a mineral oil to form a mineral oil composition; (ii) heating the mineral oil composition at a temperature of from about room temperature to about 120° C.

DETAILED DESCRIPTION OF THE INVENTION

The present invention relates to an antioxidant concentrate composition, suitable to prevent oxidation of a mineral oil, comprising dibenzylhydroxylamine (DBHA) and at least one hindered phenol selected from the group consisting of: (i) ortho-tert-butylphenol, (ii) 2,6-di-tert-butylphenol, (iii) 3,5-di-tert-butyl-4-hydroxyphenylhydrocinnamic acid, C7-C9 branched alkyl esters, (iv) 4,4'-methylenebis(2,6-di-tert-butylphenol), and mixtures thereof.

In one embodiment, the antioxidant concentrate composition comprises: about 0.1 to about 5 wt % of dibenzylhydroxylamine, about 0.1 to about 99.9 wt % of ortho-tert-butylphenol, and 0 to about 99.8 wt % of 2,6-di-tert-butylphenol, all wt % based on the total weight of the antioxidant concentrate composition.

In another embodiment, the antioxidant concentrate composition comprises: about 5 to about 20 wt % of dibenzylhydroxylamine and about 80 to about 95 wt % of ortho-tert-butylphenol, all wt % based on the total weight of the antioxidant concentrate composition.

In another embodiment, the antioxidant concentrate composition comprises: about 0.1 to about 5 wt % of dibenzylhydroxylamine, about 30 to about 95 wt % of 3,5-di-tert-butyl-4-hydroxyphenylhydrocinnamic acid, C7-C9 branched alkyl esters, and 0 to about 70 wt % of 2,6-di-tert-butylphenol, all wt % based on the total weight of the antioxidant concentrate composition.

In another embodiment, the antioxidant concentrate composition comprises: about 0.1 to about 5 wt % of dibenzylhydroxylamine and about 95 to about 99.9 wt % of 4,4'-methylenebis(2,6-di-tert-butylphenol), all wt % based on the total weight of the antioxidant concentrate composition.

In general, the antioxidant concentrate composition can also comprise: about 0.1 to about 15 wt % dibenzylhydroxylamine, or about 0.1 to about 10 wt % dibenzylhydroxylamine, or about 0.1 to about 5 wt % dibenzylhydroxylamine, or about 0.1 to about 2 wt % dibenzylhydroxylamine, or about 0.1 to about 1 wt % dibenzylhydroxylamine, all wt % based on the total weight of the antioxidant concentrate composition. Likewise, the antioxidant concentrate composition can also comprise about 85 to about 99.9 wt % of at least one hindered phenol, or about 90 to about 99.9 wt % of at least one hindered phenol, or about 95 to about 99.9 wt % of at least one hindered phenol, or about 98 to about 99.9 wt % of at least one hindered phenol, or about 99 to about 99.9 wt % of at least one hindered phenol, all wt % based on the total weight of the antioxidant concentrate composition.

This invention also relates to a mineral oil composition comprising mineral oil, dibenzylhydroxylamine and at least one hindered phenol selected from the group consisting of: (i) ortho-tert-butylphenol, (ii) 2,6-di-tert-butylphenol, (iii) 3,5-di-tert-butyl-4-hydroxyphenylhydrocinnamic acid, C7-C9 branched alkyl esters, (iv) 4,4'-methylenebis(2,6-di-tert-butylphenol), and mixtures thereof.

In one embodiment, the mineral oil comprises about 0 to about 30 wt. % aromatic hydrocarbons, about 5 to about 70 wt. % naphthenic hydrocarbons and about 5 to about 90 wt. % paraffinic hydrocarbons, all wt % based on the total weight of the mineral oil.

In one embodiment, the mineral oil comprises about 0.5 to about 30 wt. % aromatic hydrocarbons, about 5 to about 70 wt. % naphthenic hydrocarbons and about 10 to about 90 wt. % paraffinic hydrocarbons, all wt % based on the total weight of the mineral oil.

In another embodiment, the mineral oil comprises about 96 to 99.95 wt % mineral oil, about 1 ppm to about 1000 ppm of dibenzylhydroxylamine, about 0.010 to about 2 wt % of ortho-tert-butylphenol, and 0 to about 2 wt % of 2,6-di-tert-butylphenol, all wt % based on the total weight of the mineral oil composition.

In another embodiment, the mineral oil comprises about 98 to 99.75 wt % mineral oil, about 15 ppm to about 1800 ppm of dibenzylhydroxylamine, and about 0.25 to about 1.5 wt % of ortho-tert-butylphenol, all wt % based on the total weight of the mineral oil composition.

In another embodiment, the mineral oil comprises about 96 to 99.75 wt % mineral oil, about 1 ppm to about 1000 ppm of dibenzylhydroxylamine, about 0.25 to about 2 wt % of 3,5-di-tert-butyl-4-hydroxyphenylhydrocinnamic acid, C7-C9 branched alkyl esters, and 0 to about 2 wt % of 2,6-di-tert-butylphenol, all wt % based on the total weight of the mineral oil composition.

In another embodiment, the mineral oil comprises about 98 to 99.85 wt % mineral oil, about 1 ppm to about 1000 ppm of dibenzylhydroxylamine, and 0.1 to about 2 wt % of 4,4'-methylenebis(2,6-di-tert-butylphenol), all wt % based on the total weight of the mineral oil composition.

In general, the mineral oil composition can also comprise: about 1 ppm to about 10,000 ppm (i.e., 1 wt %) dibenzylhydroxylamine, or about 1 ppm to about 5000 ppm dibenzylhydroxylamine, or about 1 ppm to about 1000 ppm dibenzylhydroxylamine, or about 1 ppm to about 500 ppm dibenzylhydroxylamine, or about 1 ppm to about 250 ppm dibenzylhydroxylamine, or about 1 ppm to about 100 ppm dibenzylhydroxylamine, all wt % based on the total weight of the mineral oil composition.

Likewise, the mineral oil composition can also comprise about 0.001 to about 5 wt % of at least one hindered phenol, or about 0.01 to about 4 wt % of at least one hindered phenol, or about 0.025 to about 3 wt % of at least one hindered phenol, or about 0.025 to about 2 wt % of at least one hindered phenol, or about 0.025 to about 1 wt % of at least one hindered phenol, all wt % based on the total weight of the mineral oil composition.

In addition, the mineral oil composition can also comprise about 95 to about 99.99 wt % of mineral oil, or about 96 to about 99.95 wt % of mineral oil, or about 97 to about 99.85 wt % of mineral oil, or about 98 to about 99.75 wt % of mineral oil, or about 98.5 to about 99.5 wt % mineral oil, all wt % based on the total weight of the mineral oil composition.

The mineral oil composition may also contain additional additives so as to make the composition acceptable for use in a variety of applications. These additives include dispersants, detergents, viscosity index improvers, pour point depressants, anti-wear additives, extreme pressure additives, friction modifiers, corrosion inhibitors, rust inhibitors, emulsifiers, demulsifiers, anti-foaming agents, colorants, seal swelling agents, and additional antioxidants.

This invention also relates to a method for reducing the color of oxidized or off-color mineral oils by adding DBHA to off-color mineral oils and heating. Specifically, it is a method of reducing the color of mineral oils comprising the steps of: (i) contacting dibenzylhydroxylamine with a mineral oil to form a mineral oil composition; (ii) heating the mineral oil composition at a temperature of from about room temperature to about 120° C.

It has been discovered that DBHA has a bleaching effect on mineral oils when the composition is gently heated. Any off-color mineral oil, such as mineral oils that has increased color due to oxidative, thermal or other effects can have its color reduced by combining it with DBHA and gently heating. Examples of off-color mineral oils are those having an APHA color (as determined by ASTM D 1209) of greater than about 400, or greater than about 350, or greater than about 300, or greater than about 250, or greater than about 200, or greater than about 150, or greater than about 100.

The gentle heating can range from above about room temperature to about 120° C., or about 30° C. to about 120° C. or about 50° C. to about 100° C. The amount of time can range from about 0.25 to about 20 hours, or about 0.5 to about 10 hours or about 0.5 to about 5 hours.

EXAMPLES

The following Examples illustrate the present invention. It is to be understood, however, that the invention, as fully described herein and as recited in the claims, is not intended to be limited by the details of the following Examples.

Examples 1-7

Color Change of Aged Mineral Oil Formulations

The examples below compare several anti-oxidant mineral oil formulations and the change of Gardner color over 18 days of aging at 40° C. A mineral oil containing about 1 wt. % aromatic hydrocarbons, about 40 wt. % naphthenic hydrocarbons and about 59 wt. % paraffinic hydrocarbons was blended with 2,6-di-tert-butylphenol (Ethanox 4701 (E-4701) from Albemarle Corporation). Either dibenzylhydroxylamine (DBHA) or diethylhydroxylamine (DEHA) was added to stabilize the color. In addition, some examples had Copper (Cu) added which acts as an oxidation catalyst that accelerates aging and a N,N'-disalicylidene-1,2-propanediamine metal deactivator (Ethanox 4705).

Color was measured according to ASTM D1544, "Test Method Color of Transparent Liquids (Gardner Color Scale)", as modified in ASTM D6166, "Color of Naval Stores and Related Products (Instrumental Determination of Gardner Color)". The Gardner Color scale runs from 0 to 18, with 0 being the lightest color and 18 being the darkest. The results are shown in Table 1 below.

TABLE 1

Garner Color Change of Aged Mineral Oil Formulations

| | | Gardner Color (Aging at 40 C) | | | | | | |
|---|---|---|---|---|---|---|---|---|
| Example | Formulation | 0 days | 3 days | 6 days | 9 days | 12 days | 15 days | 18 days |
| C-1 | 0.5% wt % E-4701 | 0.2 | 0.3 | 0.3 | 0.4 | 0.4 | 0.6 | 0.6 |
| C-2 | 0.5% wt % E-4701<br>1 ppm Cu | 0.6 | 1.8 | 3.3 | 4.4 | 4.7 | 5.0 | 5.2 |
| 3 | 0.5% wt % E-4701<br>0.05% DBHA | 0.1 | 0.1 | 0.1 | 0.1 | 0.1 | 0.1 | 0.1 |
| C-4 | 0.5% wt % E-4701<br>0.05% DEHA | 0.0 | 0.1 | 0.1 | 0.1 | 0.2 | 0.2 | 0.2 |
| 5 | 0.5% wt % E-4701<br>0.05% DBHA<br>1 ppm Cu | 0.8 | 0.5 | 0.3 | 0.4 | 0.4 | 0.6 | 1.0 |

TABLE 1-continued

| Garner Color Change of Aged Mineral Oil Formulations | | | | | | | | |
|---|---|---|---|---|---|---|---|---|
| | | Gardner Color (Aging at 40 C) | | | | | | |
| Example | Formulation | 0 days | 3 days | 6 days | 9 days | 12 days | 15 days | 18 days |
| C-6 | 0.5% wt % E-4701<br>0.05% DEHA<br>1 ppm Cu | 1.2 | 1.9 | 2.8 | 2.9 | 3.2 | 3.2 | 3.3 |
| C-7 | 0.5% wt % E-4701<br>1 ppm Cu<br>0.5% wt % E-4705 | 0.6 | 0.6 | 0.7 | 0.8 | 0.9 | 1.0 | 1.0 |

The results show that Cu catalyzed Example 5 with DBHA significantly improves the color stability of the mineral oil formulation compared to Cu catalyzed Example C-2 without DBHA and Cu catalyzed Example C-6 with DEHA.

Examples 8-12

RPVOT of Mineral Oil Formulations

Rotating Pressure Vessel Oxidation Test ("RPVOT") values are an important specification test in many industrial oil applications and measure the oils ability to withstand oxidative environments. This test method utilizes an oxygen-pressured vessel to evaluate the oxidation stability of new and in-service fully formulated lubricating oils, and other finished lubricants, in the presence of water and a copper catalyst coil at 150° C. The time period required for the pressure to drop to 25 psi is a measure of the oxidation stability of the test sample: the longer the time, the better the oxidative stability of the material. The RPVOT values are measured by ASTM D 2272. The examples below compare several anti-oxidant mineral oil formulations.

A mineral oil containing about 1 wt. % aromatic hydrocarbons, about 40 wt. % naphthenic hydrocarbons and about 59 wt. % paraffinic hydrocarbons was blended with 2,6-di-tert-butylphenol (Ethanox 4701 (E-4701) from Albemarle Corporation) with and without DBHA or butylated hydroxytoluene (BHT). The results are shown in table 2 below.

TABLE 2

| RPVOT value of Mineral Oil Formulations | | | | |
|---|---|---|---|---|
| | | RPVOT value (minutes) | | |
| Example | Formulation | Run 1 | Run 2 | Average |
| C-8 | 0.5% wt % BHT | 254 | 281 | 258 |
| 9 | 0.5% wt % E-4701 | 438 | 445 | 442 |
| 10 | 0.5% wt % E-4701<br>0.0025% DBHA | 439 | 447 | 443 |
| 11 | 0.5% wt % E-4701<br>0.005% DBHA | 421 | 433 | 427 |
| 12 | 0.5% wt % E-4701<br>0.01% DBHA | 419 | 415 | 417 |

The results show that E-4701 is a much better antioxidant than BHT in mineral oils and that DBHA does not significant impact the RPVOT values.

Examples 12-15

Light Stability of Mineral Oil Formulations

A mineral oil containing about 1 wt. % aromatic hydrocarbons, about 40 wt. % naphthenic hydrocarbons and about 59 wt. % paraffinic hydrocarbons was blended with 2,6-di-tert-butylphenol (Ethanox 4701 (E-4701) from Albemarle Corporation) with and without DBHA and butylated hydroxytoluene (BHT). The formulations were exposed to sunlight for 16 days. The results are shown in table 3 below.

TABLE 3

| Light stability of Mineral Oil Formulations | | | |
|---|---|---|---|
| | | Gardner Color | |
| Example | Formulation | 0 days Light Exposure | 16 days Light Exposure |
| 12 | 0.5% wt % BHT | 0.1 | 0.3 |
| 13 | 0.5% wt % E-4701 | 0.1 | 0.8 |
| C-14 | 0.49 wt % E-4701<br>0.0025% DBHA | 0.1 | 0.1 |
| C-15 | 0.495% wt % E-4701<br>0.005% DBHA | 0.1 | 0.1 |

The results show that the mineral oils containing DBHA are more color stable to light exposure than those without DBHA. The results also show that the formulation with E-4701, without DBHA, was much more color sensitive than the formulation with BHT.

Examples 16-21

Color Reduction of Off-Color Mineral Oil

An off-color mineral oil (APHA color of 401) containing about 5 wt. % aromatic hydrocarbons, about 5 wt. % naphthenic hydrocarbons and about 90 wt. % paraffinic hydrocarbons containing 2,6-di-tert-butylphenol (Ethanox 4701 (E-4701) from Albemarle Corporation) was blended with DBHA and gently heated at temperature of 30° C., 50° C. and 70° C. for 0 to 5 hours. The Color (APHA scale) was determined by ASTM D 1209.

TABLE 4

| Effect of DBHA on APHA Color of Off-color Mineral Oil | | | | | | | | | |
|---|---|---|---|---|---|---|---|---|---|
| | | N2/ | Temp | Color - APHA Scale (Hours) | | | | | |
| Ex | Formulation | Air | ° C. | 0 | 1 | 2 | 3 | 4 | 5 |
| 16 | 99.5 wt % oil 0.5 wt % DBHA | N2 | 30 | 343 | 313 | 298 | 279 | | |
| 17 | 99.5 wt % oil 0.5 wt % DBHA | N2 | 50 | 338 | 250 | 173 | 137 | 97 | 76 |

TABLE 4-continued

Effect of DBHA on APHA Color of Off-color Mineral Oil

| Ex | Formulation | N2/ Air | Temp ° C. | Color - APHA Scale (Hours) 0 | 1 | 2 | 3 | 4 | 5 |
|---|---|---|---|---|---|---|---|---|---|
| 18 | 99.5 wt % oil 0.5 wt % DBHA | N2 | 70 | 271 | 102 | 61 | 56 | | |
| 19 | 99.5 wt % oil 0.5 wt % DBHA | Air | 30 | 361 | 346 | 332 | 313 | 301 | |
| 20 | 99.5 wt % oil 0.5 wt % DBHA | Air | 50 | 335 | 264 | 210 | 150 | 127 | |
| 21 | 99.5 wt % oil 0.5 wt % DBHA | Air | 70 | 318 | 135 | 70 | 58 | 56 | |

The APHA of the off-color mineral oil prior to combining with DBHA was 401.

The results show that when oil-containing DBHA was heated to 30° C. and above, the APHA color of the mineral oil was reduced.

Examples 22-24

Color Change of Aged Mineral Oil Formulations with 4,4'-methylenebis(2,6-di-tert-butylphenol)

A mineral oil containing about 25 wt. % aromatic hydrocarbons, about 65 wt. % naphthenic hydrocarbons and about 10 wt. % paraffinic hydrocarbons was blended with 4,4'-methylenebis(2,6-di-tert-butylphenol) (Ethanox 4702 (E-4702) from Albemarle Corporation) with and without DBHA. The above samples were placed in a conventional oven at 200° C. for 2 hrs, then the color of those samples was measured. The oven temperature was lowered to 80° C. and held at that temperature for extended time, color measurement was taken at intervals of 1, 4 and 24 hours. The data show a mixture of E-4702 and DBHA not only reduces the discoloration of the mineral oil containing E-4702, but also significantly reduces the discoloration of the mineral oil itself during heat aging process.

TABLE 5

Garner Color Change of Aged Mineral Oil Formulations with E-4702

| Example | Formulation | Gardner Color (Aging at 200° C.) 0 hours | 2 hours | Gardner Color (Aging at 80° C.) 1 hour | 4 hours | 24 hours |
|---|---|---|---|---|---|---|
| C-22 | 100% wt % Oil | 0.3 | 3.0 | 3.0 | 3.1 | 3.3 |
| C-23 | 1.0% wt % E-4702 | 0.8 | 4.0 | 4.0 | 4.0 | 4.1 |
| 24 | 0.9% wt % E-4702 0.1% DBHA | 0.5 | 1.2 | 1.1 | 1.2 | 1.2 |

Components referred to by chemical name or formula anywhere in the specification or claims hereof, whether referred to in the singular or plural, are identified as they exist prior to coming into contact with another substance referred to by chemical name or chemical type (e.g., another component, a solvent, or etc.). It matters not what chemical changes, transformations and/or reactions, if any, take place in the resulting mixture or solution as such changes, transformations, and/or reactions are the natural result of bringing the specified components together under the conditions called for pursuant to this disclosure. Thus the components are identified as ingredients to be brought together in connection with performing a desired operation or in forming a desired composition. Also, even though the claims hereinafter may refer to substances, components and/or ingredients in the present tense ("comprises", "is", etc.), the reference is to the substance, component or ingredient as it existed at the time just before it was first contacted, blended or mixed with one or more other substances, components and/or ingredients in accordance with the present disclosure. The fact that a substance, component or ingredient may have lost its original identity through a chemical reaction or transformation during the course of contacting, blending or mixing operations, if conducted in accordance with this disclosure and with ordinary skill of a chemist, is thus of no practical concern.

The invention described and claimed herein is not to be limited in scope by the specific examples and embodiments herein disclosed, since these examples and embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

The invention claimed is:

1. An antioxidant concentrate composition, suitable to prevent oxidation of a mineral oil, comprising:

(i) about 0.1 to about 5 wt % of dibenzylhydroxylamine, about 0.1 to about 99.9 wt % of ortho-tert-butylphenol, and 0 to about 99.8 wt % of 2,6-di-tert-butylphenol, all wt % based on the total weight of the antioxidant concentrate composition, or (ii) about 5 to about 20 wt % of dibenzylhydroxylamine and about 80 to about 95 wt % of ortho-tert-butylphenol, all wt% based on the total weight of the antioxidant concentrate composition (iii) about 0.1 to about 5 wt % of dibenzylhydroxylamine, about 30 to about 95wt % of 3,5-di-tert-butyl-4-hydroxyphenylhydrocinnamic acid, C7-C9 branched alkyl esters, and 0 to about 70 wt % of 2,6-di-tert-butylphenol, all wt % based on the total weight of the antioxidant concentrate composition, or (iv) about 0.1 to about 5 wt % of dibenzylhydroxylamine and about 95 to about 99.9 wt % of 4,4'-methylenebis(2,6-di-tert-butylphenol), all wt % based on the total weight of the antioxidant concentrate composition.

2. A mineral oil composition comprising mineral oil, dibenzylhydroxylamine and at least one hindered phenol selected from the group consisting of:

ortho-tert-butylphenol, 2,6-di-tert-butylphenol, 3,5-di-tert-butyl-4-hydroxyphenylhydrocinnamicacid, C7-C9 branched alkyl esters, 4,4'-methylenebis(2,6-di-tert-butylphenol), and mixtures thereof.

3. The composition of claim 2, wherein said mineral oil comprises about 0 to about 30 wt. % aromatic hydrocarbons, about 5 to about 70 wt. % naphthenic hydrocarbons and about 10 to about 90 wt. % paraffinic hydrocarbons.

4. The composition of claim 2 wherein said mineral oil comprises about 96 to 99.95 wt % mineral oil, about 1 ppm to about 1000 ppm of dibenzylhydroxylamine, about 0.010 to about 2 wt % of ortho-tert-butylphenol, and 0 to about 2 wt % of 2,6-di-tert-butylphenol, all wt % based on the total weight of the mineral oil composition.

5. The composition of claim 2 wherein said mineral oil comprises about 98 to 99.75 wt % mineral oil, about 15 ppm to about 1800 ppm of dibenzylhydroxylamine, and about 0.25 to about 1.5 wt % of ortho-tert-butylphenol, all wt % based on the total weight of the mineral oil composition.

6. The composition of claim 2 wherein said mineral oil comprises about 96 to 99.75 wt % mineral oil, about 1 ppm to about 1000 ppm of dibenzylhydroxylamine, about 0.25 to about 2 wt % of 3,5-di-tert-butyl-4-hydroxyphenylhydrocinnamic acid, C7-C9 branched alkyl esters, and 0 to about 2 wt % of 2,6-di-tert-butylphenol, all wt % based on the total weight of the mineral oil composition.

7. The composition of claim 2 wherein said mineral oil comprises about 98 to 99.85 wt % mineral oil, about 1 ppm to about 1000 ppm of dibenzylhydroxylamine, and 0.1 to about 2 wt % of 4,4'-methylenebis(2,6-di-tert-butylphenol), all wt % based on the total weight of the mineral oil composition.

8. A method of reducing the color of mineral oils comprising the steps of:

contacting dibenzylhydroxylamine with a mineral oil to form a mineral oil composition;

heating the mineral oil composition at a temperature of from about room temperature to about 120° C.

9. The method of claim 8, wherein the temperature of the mineral oil composition is from about 30° C. to about 120° C.

10. The method of claim 8, wherein the temperature of the mineral oil composition is from about 50° C. to about 100° C.

11. The method of claim 8, wherein further comprising the step of heating the mineral oil composition for about 0.25 to about 20 hours.

12. The method of claim 8, wherein the mineral oil is off-color.

* * * * *